US007776102B2

(12) United States Patent
Orietti Carella

(10) Patent No.: US 7,776,102 B2
(45) Date of Patent: Aug. 17, 2010

(54) PROCESS FOR MAKING A LEATHER ARTICLE STRUCTURE

(76) Inventor: Mauro Maria Orietti Carella, Via Durini 25, Milano (IT)

( * ) Notice: Subject to any disclaimer, the term of this patent is extended or adjusted under 35 U.S.C. 154(b) by 925 days.

(21) Appl. No.: 11/190,057

(22) Filed: Jul. 26, 2005

(65) Prior Publication Data

US 2006/0021149 A1 Feb. 2, 2006

(30) Foreign Application Priority Data

Jul. 30, 2004 (IT) ..... MI2004A1562

(51) Int. Cl.
*C14C 11/00* (2006.01)

(52) U.S. Cl. ..... 8/94.1 R

(58) Field of Classification Search ..... 8/94.1 R, 8/150.5; 252/8.57
See application file for complete search history.

(56) References Cited

U.S. PATENT DOCUMENTS 4,740,211 A * 4/1988 Siegler et al. ..... 8/94.33
2003/0212196 A1 * 11/2003 Iwato et al. ..... 524/588

* cited by examiner

*Primary Examiner*—Lorna M Douyon
*Assistant Examiner*—Amina Khan
(74) *Attorney, Agent, or Firm*—Gottlieb, Rackman & Reisman, PC

(57) ABSTRACT

The process for making a leather article structure consists of homogeneously applying a layer of substantially uniform thickness of an unpolymerised acetic silicone-based material onto the back of a leather layer, making it penetrate into the natural pores present on the back of the leather layer, and polymerising the acetic silicone-based material so as to make a support layer for the leather layer.

6 Claims, 1 Drawing Sheet

PROCESS FOR MAKING A LEATHER ARTICLE STRUCTURE

The present invention refers to a process for making a leather article structure and to the leather article structure thus made.

As known, some types of leather articles in the field of clothing, footwear and furnishing, have a structure having a leather outer layer, an intermediate support core applied to the leather layer generally through a glue and suitable for giving volume to the article, and an inner coating layer, for example a cover.

Such a leather article structure and the relative assembly process nevertheless suffer from a few drawbacks.

Firstly, the core intended to give volume also determines an undesired overall weighing down of the structure.

Moreover, the process with which the core is joined to the leather layer is sometimes extremely laborious.

The core can also have different mechanical properties to the leather layer so that tensions can arise at the interface that determine undesired deformations that worsen the appearance of the article.

Other drawbacks are directly linked to the use of glue to join the core to the leather layer, and in particular consist of the progressive worsening of the properties of the glue that in disintegrating causes, in addition to the loss of adhesiveness, bubbles and/or stains to be made on the outside of the leather layer.

Finally, such a leather article structure can, according to the glue and/or the material used for the core, have unsuitable adhesion properties between core and leather layer, poor resistance to atmospheric agents and to aging, poor resistance to UV rays and to radiations, poor chemical resistance and resistance to low temperatures, unsuitable mechanical properties, for example poor elasticity, poor mechanical strength, etc.

The technical task proposed of the present invention is, therefore, that of making a process for making a leather article structure and a leather article structure that allow the aforementioned technical drawbacks of the prior art to be eliminated.

In this technical task a purpose of the invention is that of making a leather article structure capable of keeping its original aesthetic characteristics unchanged or at least that is not subject to a deterioration that can appreciably modify its original aesthetic characteristics, which is voluminous but light, resistant to atmospheric agents and to aging, resistant to UV rays and to radiations, resistant to chemical attacks and to low temperatures, and equipped with suitable mechanical properties, in particular optimal elasticity and mechanical strength.

Another purpose of the invention is that of providing a leather article structure that, whilst having the aforementioned advantages, can be made with an extremely simple and cost-effective process.

The technical task, as well as these and other purposes, according to the present invention, are accomplished by making a process for making a leather article structure, characterised in that it consists of homogeneously applying a layer of substantially uniform thickness of an unpolymerised acetic silicone-based material onto the back of said leather layer, making it penetrate into the natural pores present on the back of said leather layer, and polymerising said acetic silicone-based material so as to make a support layer for said leather layer.

The present invention also discloses a leather article structure characterised in that it comprises a leather layer having a support layer made from acetic silicone-based material.

The leather article structure of the present invention, thanks in particular to the use of an acetic silicone-based material to make a support layer of the leather layer that sticks to the leather layer penetrating inside it and also giving body to the structure, has numerous advantageous aspects including lightness, resistance to atmospheric agents and to aging, resistance to UV rays and to radiations, chemical resistance and resistance to low temperatures, the presence of suitable mechanical properties, in particular optimal elasticity and mechanical strength.

The material of the support layer has physical/chemical properties suitable for keeping a certain degree of humidity in the leather layer, and also carries out a chemical interaction at the interface with the material of the leather layer that contributes to their close union.

The retention of humidity in the surface and inner pores of the leather layer carried out by the acetic silicone-based material determines a regeneration of the properties and of the original characteristics of the leather layer, eliminating or at least reducing possible bubbles, abrasions or other defects present on the leather layer and bringing back its elasticity and its mechanical properties to optimal values.

The acetic silicone-based material also tends to acquire a substantial biocompatibility with the leather layer.

Other characteristics of the present invention, moreover, are defined in the subsequent claims.

Further characteristics and advantages of the invention shall become clearer from the description of a preferred but not exclusive embodiment of process for making a leather article structure and of the leather article structure thus made according to the finding, illustrated for indicating and not limiting purposes in the attached drawings:

Figure 1:
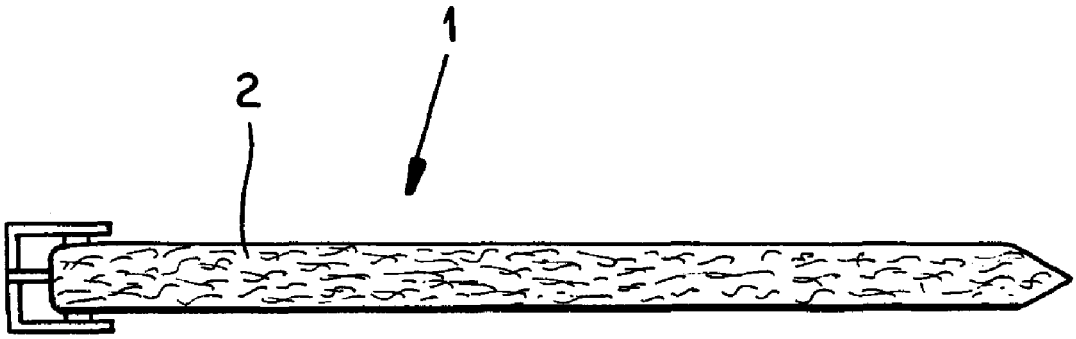
FIG. 1 shows a plan view of a leather belt structure according to the present invention.
Figure 2:
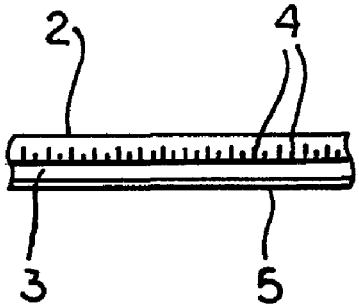
FIG. 2 shows a top side section view of a part of the leather belt structure of FIG. 1.

With reference to the quoted figures, a leather belt structure is shown wholly indicated with reference numeral 1.

It is clear from here on that what shall be said can also be extended for any leather article structure in the field of clothing, footwear and furnishing.

The structure 1 comprises a leather layer 2 having a support layer 3 made from acetic silicone-based material.

The acetic silicone-based material penetrates into the pores 4 of the leather layer 2.

In the acetic silicone-based material there is acetic acid in a percentage preferably within a range of between 5% and 30% vol.

The percentage of acetic acid in the acetic silicone-based material varies substantially directly proportionally to the thickness of the leather layer 2.

Indeed, a higher concentration of solvent in the acetic silicone-based material before polymerisation determines a greater fluidity that allows the acetic silicone-based material to penetrate more easily into the pores 4 going through a greater thickness of the leather layer 2 whereas a lower concentration of solvent in the acetic silicone-based material before polymerisation determines a greater viscosity that allows the acetic silicone-based material to penetrates less easily into the pores 4 going through a smaller thickness of the leather layer 2.

The back of the leather layer 2 preferably has a skiving having the dual purpose of opening the pores 4 and of controlling and in particular reducing the thickness of the leather layer 2.

The acetic silicone-based material can have a resin-based additive to increase the bearing effect of the support layer 3.

The structure 1 is preferably completed by a coating layer 5 of the support layer 3, for example consisting of a cover or another leather layer.

The process for making the leather article structure consists of homogeneously applying a layer of substantially uniform thickness of an unpolymerised acetic silicone-based material onto the back of said leather layer 2, making it penetrate into the natural pores 4 present of the leather layer 2, and polymerising the acetic silicone-based material so as to make the support layer 3 for the leather layer 2.

It is important to apply a layer of uniform thickness of acetic silicone-based material so as to allow the uniform penetration into the pores 4 and uniform retention of humidity in the leather layer 2.

As stated, the back of the leather layer 2 is preferably skived to promote the penetration of the unpolymerised acetic silicone-based material into the pores 4.

The application of the acetic silicone-based material can be carried out in many steps.

In particular, a first amount of unpolymerised acetic silicone-based material is applied to the back of the leather layer 2 with the use of a suitable pressure to promote its penetration into the pores 4.

Then, at least a second amount of unpolymerised acetic silicone-based material is applied to the back of the leather layer 2 to increase the thickness of the support layer 3 that is being made. In this case, the application does not require the use of pressure.

The unpolymerised acetic silicone-based material before application can be subjected to agitation suitable for increasing the capture of air and the foamy consistency.

Moreover, as stated, the unpolymerised acetic silicone-based material before application can be additived with a resin-based material suitable for improving the bearing effect of the support layer 3 that is being made, whilst still maintaining the characteristics of lightness.

In a possible way of application, the unpolymerised acetic silicone-based material containing silicone in a concentration of about 85% vol and acetic acid in a concentration of about 15% vol is subjected to agitation for 5 minutes at room temperature, before being spread many times over on the cleaned and skived back of the leather layer 2.

The back of the leather layer 2, apart from cleaning and skiving, is not subjected to any other type of activation or treatment before the application of the acetic silicone-based material.

After having homogeneously laid down one of more layers of uniform thickness of acetic silicone-based material, it is left to polymerise for about 24 hours.

At the end of polymerisation the coating layer 5 is applied, for example through sewing with the leather layer 2.

So as not to complicate the sewing operation, the sewing points between the coating layer 5 and the leather layer 2 are preferably outside the application zone of the acetic silicone-based material.

The process for making a leather article structure and a leather article structure thus conceived can undergo numerous modifications and variants, all of which are covered by the inventive concept; moreover, all of the details can be replaced with technically equivalent elements.

In practice, the materials used, as well as the sizes, can be whatever according to the requirements and the state of the art.

The invention claimed is:

1. A process for making a leather article structure, the process comprising the steps of:

homogeneously spreading with application of pressure at least a first layer of substantially uniform thickness of an unpolymerized acetic silicone-based material onto the back of a leather layer and thereby making the layer penetrate substantially uniformly into the natural pores of said leather layer so as to maintain a substantially uniform level of humidity in said leather layer, wherein said unpolymerized acetic silicone-based material comprises about 15% acetic acid by volume and about 85% silicone by volume, and polymerizing said acetic silicone-based material so as to make a support layer for said leather layer.

2. The process for making a leather article structure according to claim 1, further comprising the step of shaving the back of said leather layer to promote the penetration of said unpolymerized acetic silicone-based material into said pores.

3. The process for making a leather article structure according to claim 1 wherein a second layer of said unpolymerized acetic silicone-based material is applied to the back of said leather layer over the first layer to increase the thickness of said support layer.

4. The process for making a leather article structure according to claim 1, further comprising the step of agitating said unpolymerized acetic silicone-based material before application for increasing air content of the silicone-based material.

5. The process for making a leather article structure according to claim 1, further comprising the step of adding to said unpolymerized acetic silicone-based material before application a resin-based material suitable for improving the bearing effect of said support layer.

6. A process for making a leather article structure, the process comprising the steps of:

homogeneously spreading with application of pressure a first layer of an unpolymerized acetic silicone-based material onto the back of a leather layer and thereby making the first layer penetrate substantially uniformly into the natural pores of said leather layer so as to maintain a substantially uniform level of humidity in said leather layer, wherein said unpolymerized acetic silicone-based material comprises about 15% acetic acid by volume and about 85% silicone by volume;

applying a second layer of said unpolymerized acetic silicone-based material to the back of said leather layer on the first layer to increase the thickness of the first layer and produce a combined layer of uniform thickness; and polymerizing the unpolymerized acetic silicone-based material of both layers so as to make a support layer for said leather layer.

* * * * *